United States Patent [19]

Phillips et al.

[11] Patent Number: 4,974,904

[45] Date of Patent: Dec. 4, 1990

[54] ROCKING CHAIR APPARATUS

[76] Inventors: E. Lakin Phillips, 2733 Centerville Rd., Herndon, Va. 22071; Bernardino Romero, 8500 S.W. 99th Ave., Miami, Fla. 33173

[21] Appl. No.: 425,419

[22] Filed: Oct. 23, 1989

[51] Int. Cl.[5] ..... A47C 3/02

[52] U.S. Cl. ..... 297/258; 297/264

[58] Field of Search ..... 297/258, 260, 264, 265, 297/266, 349, 270, 304; 248/575, 578, 425

[56] References Cited

U.S. PATENT DOCUMENTS

| | | | |
|---|---|---|---|
| 648,916 | 5/1900 | Bowers | 297/264 |
| 718,394 | 1/1903 | Siegrist | 297/270 |
| 1,279,229 | 9/1918 | Bilan | 297/304 X |
| 2,689,599 | 9/1954 | Mauser | 297/304 X |
| 2,964,094 | 12/1960 | Gariepy | 248/425 X |
| 3,333,811 | 8/1967 | Matthews | 297/264 X |
| 3,374,981 | 3/1968 | Stuckenberger et al. | 248/575 X |
| 3,659,895 | 5/1972 | Dresden | 248/425 X |
| 4,598,946 | 7/1986 | Cone | 297/258 |
| 4,736,984 | 4/1988 | Tacker | 297/264 |
| 4,768,829 | 9/1988 | Goldman | 297/349 X |

FOREIGN PATENT DOCUMENTS

| | | | |
|---|---|---|---|
| 1138328 | 1/1989 | United Kingdom | 297/258 |

*Primary Examiner*—Jose V. Chen

*Attorney, Agent, or Firm*—Herbert W. Larson

[57] ABSTRACT

A hemisphere with an integral outer flange is attached to the flat bottom surface of a chair. A cone shaped base depends from the convex bottom of the hemisphere and is separated from the hemisphere by an annular member having a multiplicity of roller bearings seated on its top surface and in contact with the convex surface of the hemisphere. The cone base has a flat bottom plate connected to the first end of a turn-buckle. A second end of the turn-buckle is connected to a spring connected in turn to the hemisphere. An increase or decrease in the tension exerted on the the spring controls the degree of rocking of the chair.

10 Claims, 3 Drawing Sheets

ROCKING CHAIR APPARATUS

BACKGROUND OF THE INVENTION

1. Field of the Invention

This invention relates to rocking chairs. More particularly, it refers to an apparatus for attachment to the underside of the flat seat portion of a standard chair to convert such chair into a rocking chair.

2. Description of the Prior Art

Rocking chairs in various configurations such as seen in U.S. Pat. Nos. 2,054,487 and 4,025,101 are well known. Many of these prior art rocking chairs are made by converting a standard four leg chair. The chair is changed by removing the legs and substituting to the bottom of the chair a hemispherical attachment. Many of these converted chairs are unstable and do not achieve the desired rocking motion for the chair occupant, particularly an older occupant who cannot withstand severe tilts. An attachment to a standard chair is needed so that the chair can be converted into a rocker with the rocking motion adjusted to the liking of the chair occupant.

SUMMARY OF THE INVENTION

I have discovered an apparatus for attachment to a bottom surface of a standard chair seat which converts the chair to a rocker. In addition, the degree of rocking can be adjusted to the ultimate liking of the chair occupant.

My apparatus contains a hemisphere having an integral outer flange attached to a bottom surface of a chair seat. A cone shaped base depends from an annular member interposed between a convex bottom portion of the hemisphere and the base. The hemisphere rotates on multiple roller bearings seated within a top surface of the annular member. A turn-buckle is attached to the middle of a plate in a cone shaped base unit and connects through a spring to a bottom of the hemisphere. By adjusting the turn-buckle, which in turn adjusts the spring tension, the degree of movement of the hemisphere can be increased or decreased to permit lessor or greater movement as desired by the seat occupant.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
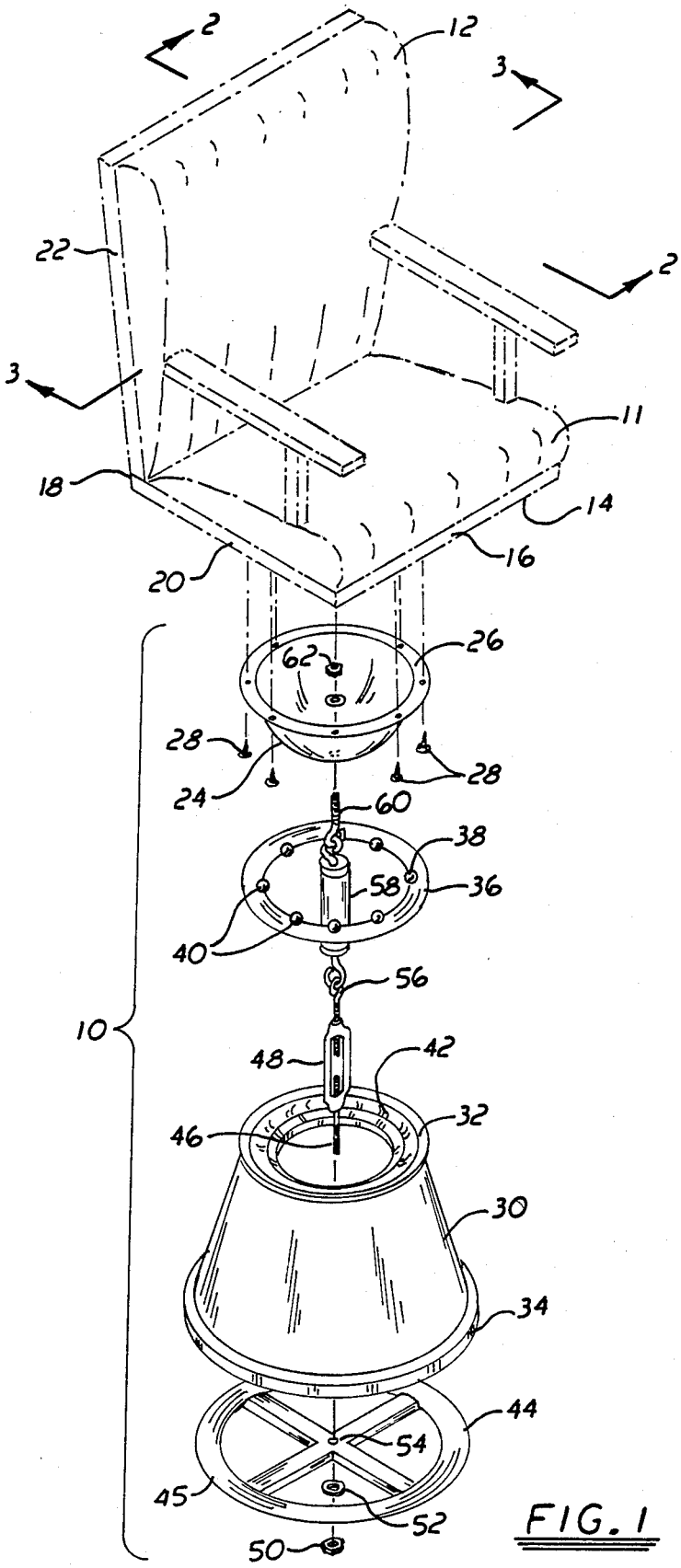
FIG. 1 is an exploded view of the rocking chair with its rocker attachment.
Figure 2:
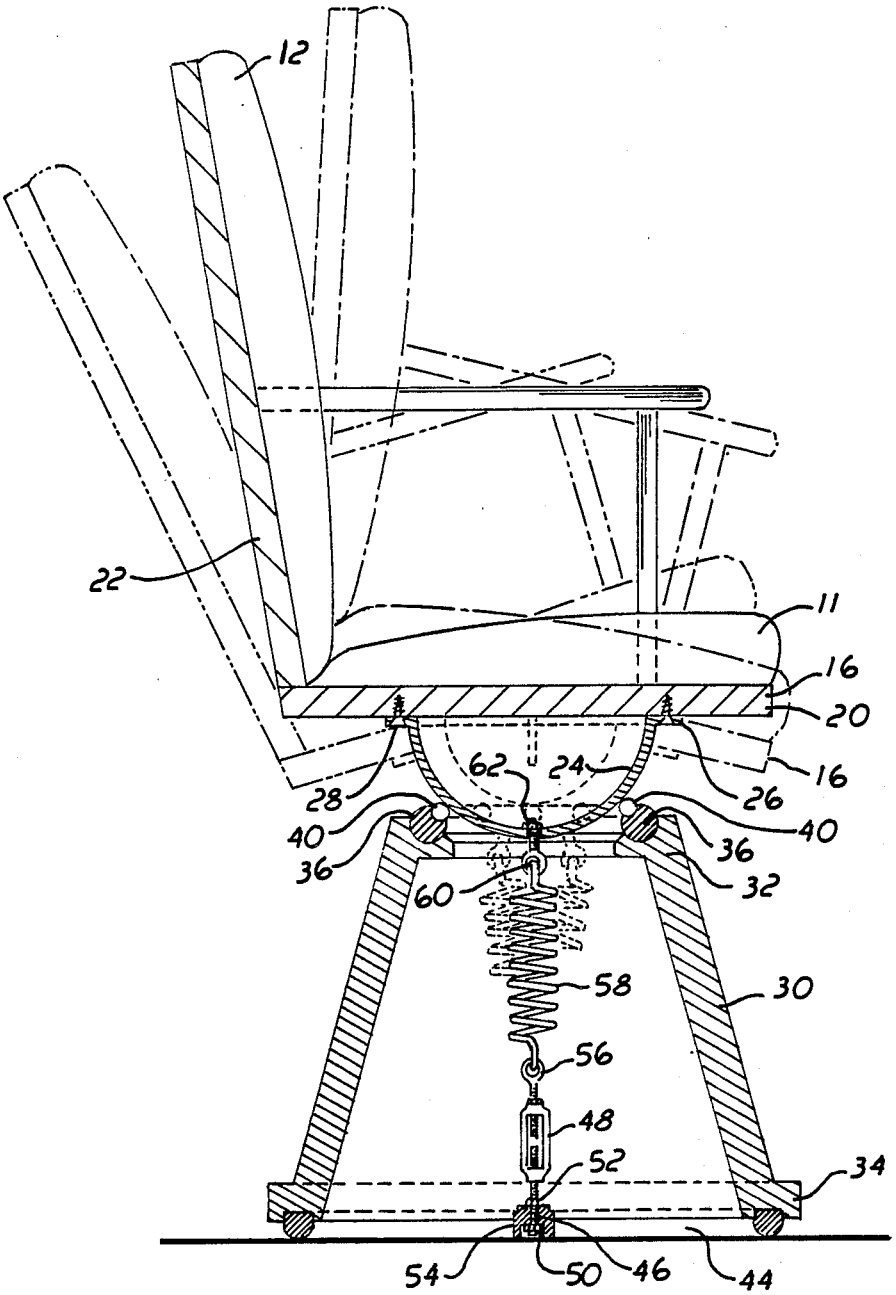
FIG. 2 is a side elevation view in section along lines 2—2 of FIG. 1.
Figure 3:
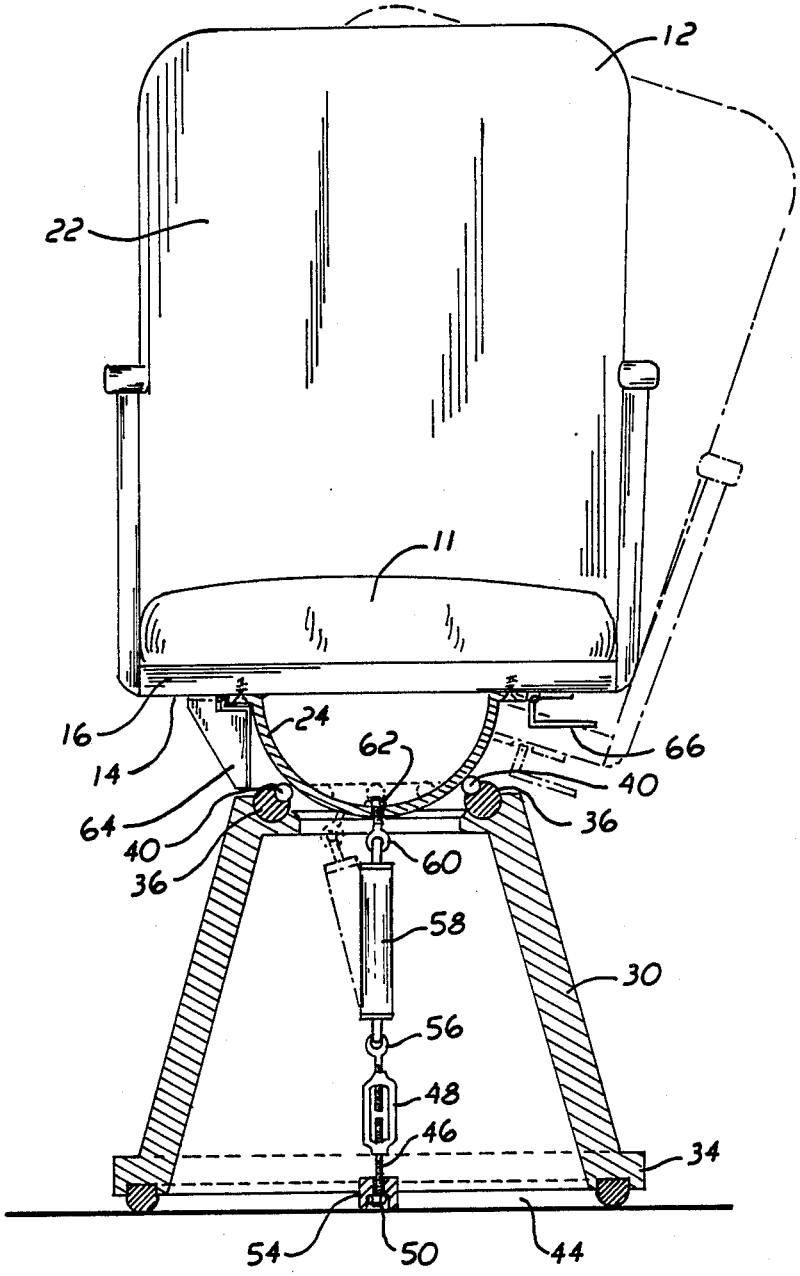
FIG. 3 is a front elevation view in section along lines 3—3 of FIG. 1.

Throughout the following detailed description the same reference numerals refer to the same element in all figures.

The rocker apparatus 10 shown in FIG. 1 is substituted for legs (not shown) removed from chair 12. Chair 12 has a seat portion 11. The seat 11 has a planar bottom surface 14, front edge 16, back edge 18 and side edges 20. An upright backrest 22 is attached to the seat 11.

A hemisphere 24 having an integral outer planar flange 26 attached to it at its widest periphery is screwed into the center of seat bottom surface 14. Screws 28 are used to attach the hemisphere 24 through the flange 26 to seat bottom surface 14.

Interposed between a cone 30 having an upper annular edge 32 of narrower diameter than the lower annular edge 34 and acting to separate the cone 30 from the hemisphere 24 is an annular member 36 containing multiple spaced apart concave indentations 38. Each indentation 38 seats a ball bearing 40. Five to ten ball bearings 40 can be used, but usually seven are adequate.

The annular member 36 rests within a groove 42 located at the top of cone 30 below edge 32. The hemisphere 24 rotates on top of the balls 40. The inner surface of lower edge 34 of cone 30 receives a ring or circular plate 44 having radial arms meeting at a center portion 54 and connecting the outer rim 45 to the center portion 54.

A first end 46 of a turn-buckle 48 is attached at center portion 54 of plate 44. The end 46 is bolted by nuts 50 and 52 to the middle portion 54 of plate 44. A second end 56 of turn-buckle 48 is attached to a spring member 58 which is engaged by hook 60 and nut 62 to the hemisphere 24.

The turn-buckle 48 can be adjusted to tighten the spring 58 so that the rocking motion is shortened or the turn-buckle 48 can be loosened so that the rocking motion is extended. Stop 64 or 66 can be placed on the bottom 14 of seat 11 to provide for restriction in side to side movement of the chair 12.

The occupant sitting in the chair 12 merely has to move his or her body forward or backward in order to obtain the proper rocking motion.

Various equivalent items can be substituted for the elements of the rocker apparatus to arrive at equivalent results.

Having thus described the invention what is claimed and desired to be secured by Letters Patent is:

1. A rocking chair comprising:

a seat member having a planar bottom surface, front and back edges and side edges with an upright back rest attached to the seat member over the back edge,.

a hemisphere having a convex surface facing downwardly and having an integral outer planar flange around its widest periphery attached to the bottom surface of the seat member, an annular member containing on an upper surface multiple spaced apart ball bearings in contact with a bottom portion of the convex surface and a lower surface of the annular member seated within a narrow upper end of a cone shaped base member, a wider lower end of the cone shaped base member incorporating a base plate, an adjustable holding member attached to a spring member located centrally within the base member joining the base plate under spring tension to a bottom of the convex surface and the spring tension being governed by changes to the adjustable holding member.

2. The rocking chair according to claim 1 wherein the upper surface of the annular member contains multiple concave indentations for seating the ball bearings.

3. The rocking chair according to claim 2 wherein the lower surface of the annular member is seated within an annular groove of the cone shaped base member.

4. The rocking chair according to claim 1 wherein the base plate is an annular plate having a center portion joined to a rim by multiple radial arms.

5. The rocking chair according to claim 4 wherein the center portion of the base plate is connected to a first end of a turn-buckle and a second end of the turn-buckle is connected to a spring.

6. The rocking chair according to claim 5 wherein the spring is connected to the turn-buckle at a first end and to a lowest portion of the convex surface at its second end.

7. The rocking chair according to claim 1 wherein the spring tension is adjusted by turning a turn-buckle.

8. A rocking chair comprising a seat member and a back rest, a having a convex surface facing downwardly hemisphere having an integral outer flange around its widest periphery, the flange affixed to a lower surface of the seat member, an annular member containing multiple ball bearings seated on an upper surface of the annular member in contact with a lower portion of the convex surface, a lower surface of the annular member in contact with an upper portion of a cone shaped base member, a lower portion of the cone shaped base member incorporating a circular plate having multiple radial arms connecting a rim and a center portion of the plate, a spring member connecting at a second end to the lower portion of the convex surface and at a first end to a means for adjusting spring tension the means for adjusting spring tension being attached to the spring at a second end and to the center portion of the plate at a first end.

9. The rocking chair according to claim 8 wherein the means for adjusting spring tension is a turn-buckle attached to the spring at a second end and attached to the center portion of the plate at a first end.

10. The rocking chair according to claim 8 wherein seven ball bearings are seated in the upper surface of the annular member.

* * * * *